US005507321A

United States Patent [19]

Kutsukake et al.

[11] Patent Number: 5,507,321

[45] Date of Patent: Apr. 16, 1996

[54] HEALD FRAME FOR WEAVING A SLIDE FASTENER STRINGER

[75] Inventors: Kenji Kutsukake; Kihei Takahashi; Hisayoshi Kato; Yoshiharu Tanaka, all of Toyama, Japan

[73] Assignee: YKK Corporation, Tokyo, Japan

[21] Appl. No.: 285,742

[22] Filed: Aug. 4, 1994

[30] Foreign Application Priority Data

Aug. 25, 1993 [JP] Japan ..... 5-210739

[51] Int. Cl.[6] ..... D03C 5/02

[52] U.S. Cl. ..... 139/116.1; 139/58; 139/81; 139/91; 139/384 B; 139/93

[58] Field of Search ..... 139/58, 384 B, 139/91, 118, 116.1, 81, 82, 93, 57

[56] References Cited

U.S. PATENT DOCUMENTS

| | | | |
|---|---|---|---|
| 2,142,615 | 1/1939 | Nicolet | 139/11 |
| 3,085,597 | 4/1963 | Dolbeare | 139/81 X |
| 3,152,619 | 10/1964 | Bulley et al. | 139/58 |
| 3,796,235 | 3/1974 | Muller | 139/82 X |
| 4,519,424 | 5/1985 | Ishido et al. | 139/91 |
| 5,280,810 | 1/1994 | Shimizu | 139/91 |

FOREIGN PATENT DOCUMENTS

| | | | |
|---|---|---|---|
| 189229 | 11/1922 | United Kingdom | 139/91 |

*Primary Examiner*—Andy Falik
*Attorney, Agent, or Firm*—Hill, Steadman & Simpson

[57] ABSTRACT

A heald frame comprises: a heald support frame for supporting a plurality of healds in parallel, the heald support frame having a central plate portion and a pair of ring-shaped rectangular heald supporting portions extending in opposite directions from the central plate portion; and a heald support extending perpendicularly from the central plate portion, the heald support being integrally connected to the central plate portion of the heald support frame via a generally V-shape joint. The heald frame is made from a reinforced composite material composed of a synthetic resin and a reinforcing filler. Each of the heald supporting portions includes one lower supporting rod for supporting at least a heald.

7 Claims, 4 Drawing Sheets

HEALD FRAME FOR WEAVING A SLIDE FASTENER STRINGER

BACKGROUND OF THE INVENTION

1. Field of the Invention:

This invention relates to a heald frame for use in a narrow-width loom for weaving a continuous row of coupling elements in the form of a coiled synthetic resin filament into a woven fastener tape simultaneously with the weaving of the tape, and to a heald supported by the heald frame. More particularly this invention relates to a heald frame structure which is adequately tough and can achieve weight reduction, and to a heald structure which can be attached to and detached from the heald frame with ease.

2. Description of the Related Art:

In this kind of loom, a known conventional shedding device comprises a plurality of heald frames which are to be moved upwardly and downwardly by the same number of plate cams mounted on a common rotary shaft. Since the thickness of the individual cam plate has a lower limit in view of toughness, the length of the heald frame row cannot be smaller than a certain limit so that the difference in height of the sheds made respectively by the frontmost heald frame and the end heald frame would be large.

A shedding device which is free from such time difference in movement between the heald frames is disclosed in, for example, Japanese Utility Model Publication No. SHO 58-48383. In the shedding device, a pair of parallel rotary shafts extends under a row of heald frames, and as many plate cams as the heald frames are mounted alternately on the two rotary shafts, namely, plate cams half in number as the heald frames are supported by each rotary shaft. The individual plate cams are associated with respective cam followers which are arranged in a staggered pattern along the heald frame row for moving upwardly and downwardly in response to the movements of the plate cams. Without changing the thickness of the individual plate cams, the length of the row of the heald frames is reduced to about half the conventional length to minimize the difference in vertical movement between the front and end heald frames so that the degree of fatigue of the individual parts which move vertically is reduced, thus increasing the operating speed of the loom.

However, since all components of the conventional heald frame are made of steel, it would necessarily be that the total weight of the vertically moving parts including healds and heald frame attachments will be significantly large still in the present operating speed. More specifically, the total weight of the moving parts including the heald frames, healds, heald frame attachments and other associated members of the shedding device is about 2.1 kg, and the upper limit of operating speed of the loom for such weight is 1,500 rpm. If the loom is operated over the operating speed limit, influences due to the force of inertia of the individual moving parts would increase so that play would be created in the joints of the heald frames or the joints of the heald support rods and the heald frames would be broken or otherwise damaged, thus resulting in a non-stable continuous operation.

SUMMARY OF THE INVENTION

It is therefore an object of this invention to secure an adequate degree of toughness of moving parts in a shedding device and to reduce the weight of the moving parts, thus enabling a loom to operate at high speed. Another object of the invention is to provide a heald having such an attachment structure as to facilitate exchanging the heald with a new one. According to a first aspect of the invention, a heald frame comprises a heald support frame for supporting a plurality of healds in parallel, which has a central plate portion and a pair of ring-shaped rectangular heald supporting portions extending in opposite direction from the central plate portion. The heald frame also comprises a heald support extending perpendicularly from the central plate portion, which is integrally connected to the central plate portion of the heald support frame via a generally V-shape joint. Each of the heald supporting portions includes a lower supporting rod for supporting at least a heald. The whole of the heald frame is made from a reinforced composite material composed of a synthetic resin and a reinforcing filler.

The heald comprises a bridge having a groove for receiving a heald supporting rod and a heald body having a base adapted to be slidably connected with the bridge for gripping the heald supporting rod with the bridge. The heald also comprises means for fastening the heald supporting rod between the bridge and a base of the heald body in such a manner that the heald supporting rod is surrounded by the groove of the bridge and a part of the base of the heald body, the bridge and the base of the heald body having male and female joint portions which are complementary in shape to each other and are slidably and detachably fitted in each other.

Since the heald frame having a generally T-shape contour is a synthetic resin molded product reinforced by a multilayer fibrous structure, it is possible to reduce the weight of the whole frame structure and also to secure adequate toughness. Further, the heald frame made of such a composite material is increased in bending strength and coefficient of bending elasticity, compared to the conventional art. Partly since the heald support and the heald supporting portions are connected by the generally V-shape joint, on which the largest inertia acts, and partly since the individual heald supporting portions, on which the load due to warp yarns during shedding acts, has a rectangular shape, it is possible to secure adequate toughness against inertia and violent motions during high-speed operation.

For mounting the heald on the supporting rod of the heald frame, firstly the supporting rod is inserted through the groove of the bridge, and then the joint portion of the base of the heald is coupled with the companion joint portion of the bridge by sliding from sideways. Then a screw is turned to threadedly extend through a threaded hole of the bridge until the distal end of the screw presses against the supporting rod, thus fastening the supporting rod firmly. It is possible to remove the heald from the supporting rod of the heald frame simply by tracing the same procedure reversely.

DETAILED DESCRIPTION

Figure 1:
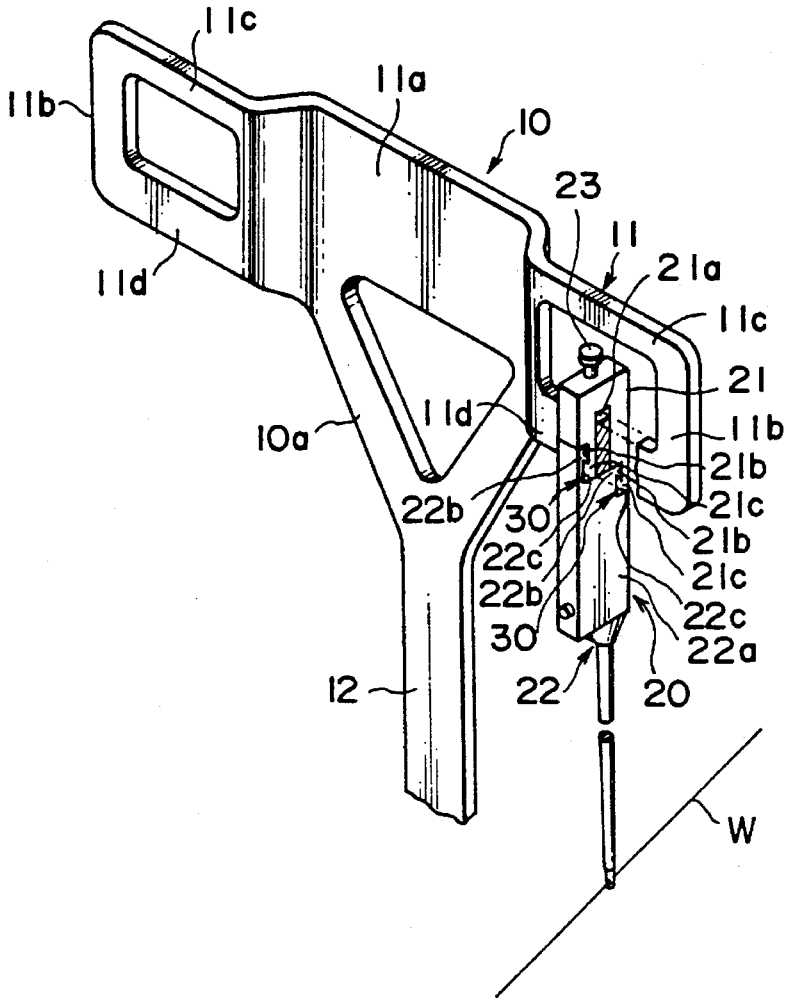
FIG. 1 is a fragmentary perspective view showing a heald frame and a heald according to this invention.

An embodiment of a heald frame of this invention will now be described in detail with reference to the accompanying drawings. FIG. 1 is a fragmentary perspective view showing a typical structural example of the heald frame. The illustrated heald frame 10 comprises a heald support frame 11 for supporting a plurality of healds 20 in parallel, and a heald support 12 extending perpendicularly from the heald support frame 11. The heald support frame 11 has a central plate portion 11*a* and a pair of rectangular ring-shaped supporting portions 11*b* extending horizontally in opposite directions from the central plate portion 11*a*. The heald support 12 is integrally connected to the central plate portion 11*a* of the heald support frame 11 via a generally V-shape joint 10*a* to form the whole heald frame 10 in a generally T shape. There is a difference between the general plane of the central plate portion 11*a* and that of the rectangular heald supporting portions 11*b* so as to bring the healds 20 near the shed at maximum.

As a characterized part of this invention, the heald frame 10 is made from a reinforced composite material composed of a synthetic resin, as a basic material, and a reinforcing filler. The characteristics required for the heald frame 10 are exemplified by that it is high in toughness, light in weight, good in moldability and secondary workability, and low in cost of material. Regarding the toughness, the heald frame 10 requires, for example, a bending strength of at least 40 $kg/mm^2$ and a coefficient of bending elasticity of 1550 $kg/mm^2$. Further, in order to realize reduction of weight, it is desirable not only to reduce the specific gravity of the raw material but also to reduce the specific gravity of the final product.

In order to meet these requirements, it is preferable to use a composite material composed of a synthetic resin whose specific gravity is lower than metal, as a basic material and a fibrous material, as a reinforcing filler. The synthetic resin may be a thermoplastic resin, such as nylon, poly(phenylene sulfide)(PPS), polypropylene (PP), polycarbonate (PC) or polyester. The synthetic resin should by no means be limited to a thermoplastic resin and may be a thermosetting resin.

The fibers as a reinforcing filler may be carbon fibers (CF), glass fibers (GF) or metal fibers.

Figure 2:
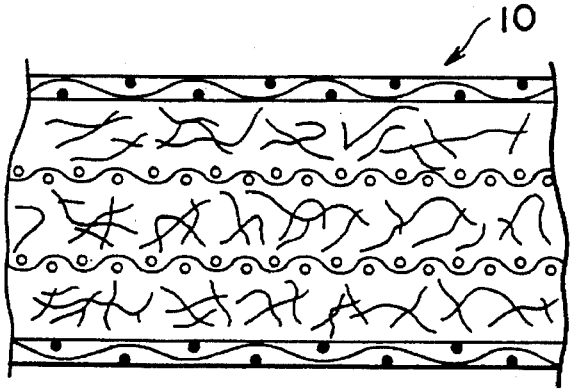
FIG. 2 is a fragmentary cross-sectional view showing the internal structure of the heald frame.

In this embodiment, the generally T-shape heald frame 10 has a multilayer structure as shown in FIG. 2. Specifically, a woven cloth containing CF or GF of 40–70 weight % and a resin raw material equivalent to the basic material of 60–30 weight % is disposed over each of front and rear surface layers fo the heald frame 10, or yarns of the same material extend in the surface layers in both warpwise and weftwise directions, to secure adequate regidness of the surfaces. In an intermediate layer, two 10–200 mesh metal nets of SUS, Ni wires having a 40–300 μm are disposed one over another with a gap therebetween to secure adequate toughness of the entire heald frame structure. In addition, each of three-layers of random mats containing GF of 35–45 weight % and a raw material equivalent to the basic material of 65–55 weight % is disposed in each of the gaps between the front and rear surface layers and the double metal net to improve the degree of firmness of joining the adjacent layers together.

With the resulting heald frame 10, it is possible to improve the bending strength and bending elasticity. Further, in order to secure adequate structural toughness against inertia and severe motion under high-speed operation, the heald support 12 supporting the central portion of the heald support frame 11, on which portion the greatest inertia is exerted, has the generally V-shape joint 10*a*, and the heald support frame 11, on which large load due to warp yarns is exerted during the shedding, has a rectangular shape.

With this heald frame structure, it is impossible to attach the conventional heald having at one end an insertion hole through which the heald supporting rod is to be inserted. However, the heald 20 of this invention can be detachably attached not only to an ordinary conventional heald supporting rod but also to the rectangular heald support frame 11 having a unique structure.

Specifically, the heald 20 comprises a bridge 21 having a groove 21*a* through which a lower supporting rod 11*d* of the rectangular heald support frame 11 is to be inserted, a heald body 22 having a base 22*a* adapted to be coupled with the bridge 21 from its side by sliding and to grip the lower supporting rod 11*d* in cooperation with the bridge 21, and a fastening means 23 for fastening the lower supporting rod 11*d* between the groove 21*a* of the bridge 21 and the base 22*a* of the heald body 22 in such a manner that the lower supporting rod 11*d* is surrounded by the groove 21*a* of the bridge 21 and a portion of the base 22*a* of the heald body 22. The bridge 21 and the heald body's base 22*a* have male and female joint portions 30 which are complementary in shape to each other and are slidably and detachably fitted in each other.

In FIG. 1, a typical example of the heald 20 is shown. The groove 21*a* of the bridge 21 has such a shape as to surround three sides of the lower supporting rod 11*d*. The joint portion 30 of the bridge 21 has at its open end grooves 21*b* and projections 21*c*, and the companion joint portion 30 of the base 22*a* of the heald body 22 has projections 22*b* and grooves 22*c* which are complementary in shape to the grooves 21*b* and projections 21*c* of the bridge 21. The bridge 21 has centrally in its closed end wall a threaded hole through which a screw 23 serving as the fastening means is threadedly inserted.

For attaching the heald 20 to the lower supporting rod 11*d* of the heald frame 10, firstly the lower supporting rod 11*d* is inserted through the groove 21*a* of the bridge 21 and then the projections 22*b* of the base 22*a* are inserted into the grooves 21*b* of the bridge 21 sideways by sliding and at the same time the projections 21*b* of the bridge 21 are inserted into the grooves 22*c* of the base 22*a* sideways by sliding. Then the screw 23 is threaded being inserted into the threaded hole of the bridge 21 to fasten the lower supporting rod 11*d* between the distal end of the screw 23 and the lower-supporting-rod-contacting surface of the base 22*a* firmly.

Figure 3:
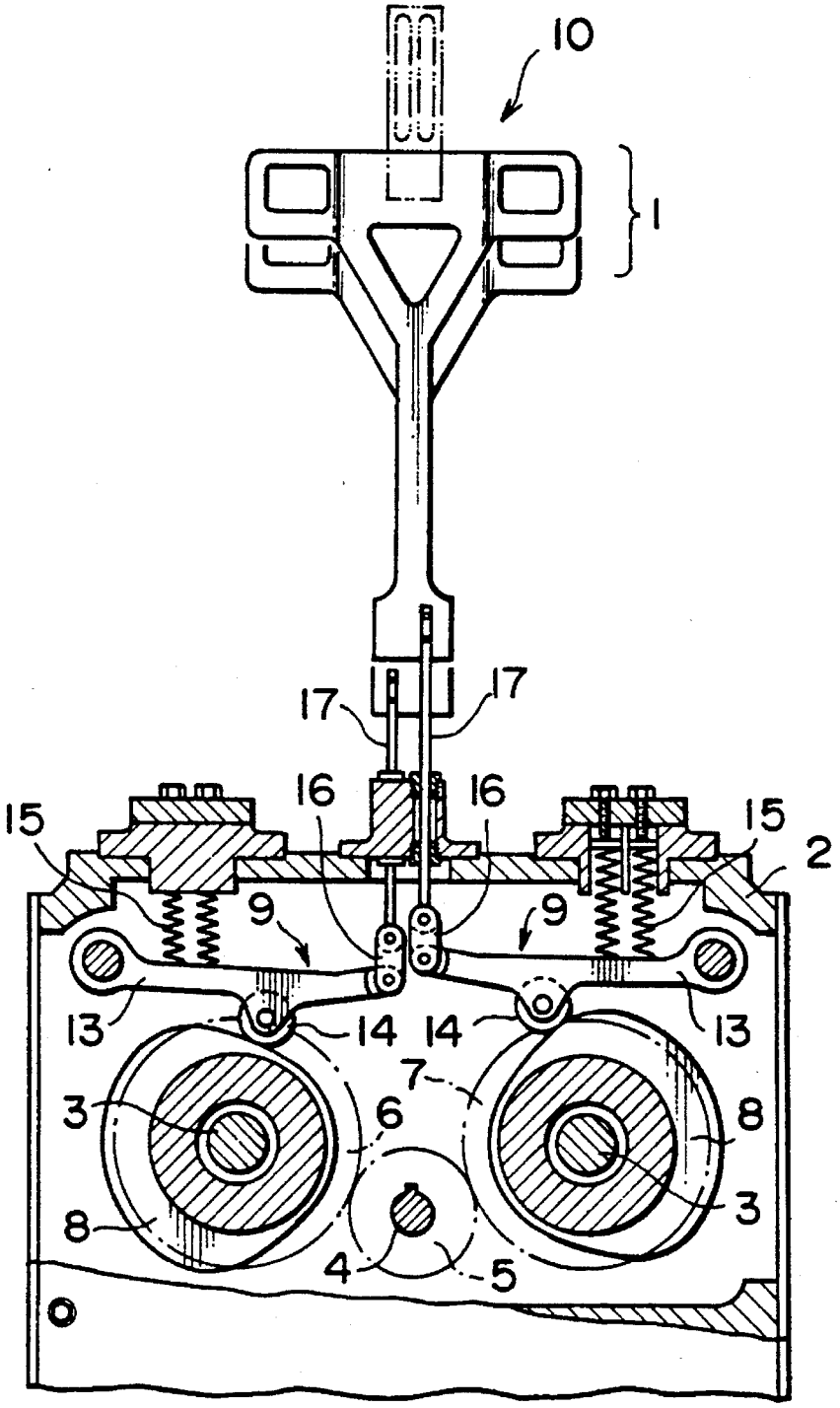
FIG. 3 is a transverse cross-sectional view showing a shedding device of a fastener stringer weaving loom in which a plurality of the heald frames are arranged one behind another in the direction of warp yarns.

FIG. 3 is a transverse cross-sectional view showing a shedding device of a fastener stringer weaving loom in which a predetermined number of heald frames 10 are positioned one behind another and a plurality of healds are attached to both the right and left lower supporting rods 11*d*. The drive mechanism of the shedding device is substantially identical with that disclosed in Japanese Utility Model Publication No. SHO 58-48383. In a housing 2 under the heald frame row 1, a pair of rotary shafts 3, 3 are arranged in parallel one on each side of the heald frame row 1. The drive mechanism has a drive shaft 4 positioned between the two rotary shafts 3, 3, and gears 5, 6, 7 operatively connecting the drive shaft 4 with the two rotary shafts 3, 3 for rotation in opposite directions.

On each rotary shaft 3, as many plate cams 8 as the heald frames 1 are mounted. The plate cams 8 are mounted alternately on the two rotary shaft 3, 3 in association with the corresponding heald frames 10. Each plate cam 8 is operatively connected to a cam follower 9 which is movable upwardly and downwardly in response to the rotation of the plate cam 8. The cam follower 9 has a lever 13 pivotally mounted at its outer end on the housing 2 and extending perpendicular to the rotary shaft 3. A roller 14 is supported on a central portion of the lever 13 and is normally urged against the plate cam 8 by a spring 15 situated between the housing 2 and the lever 13. Further, the cam follower 9 is connected at its inner or free end to the lower end of a vertical rod 17 via a link or connector 16, the vertical rod 17 supporting the lower end of the corresponding heald frame 10.

With the shedding device, since as many plate cams 8 as the heald frames 10 are mounted alternately on the two rotary shafts 3, 3 located under the heald frame row 1 in association with the individual heald frames 10, it is possible to arrange the plate cams 8 on each rotary shaft 3 in association with every other heald frames 10 so that the gap between the adjacent heald frames 10 can be reduced and hence the thickness of the individual plate cam 8 can be increased within an allowable range, thus securing an adequate degree of toughness of the heald frame structure. Therefore, partly since the warpwise length of the heald frame row 1 is substantially half the conventional heald frame row length to minimize the shedding motions of the heald frames 10, and partly since the heald frames 10 realizing reduction of weight and increase of toughness are used, it is possible to guarantee an adequate degree of toughness under high-speed operation.

Figure 4:
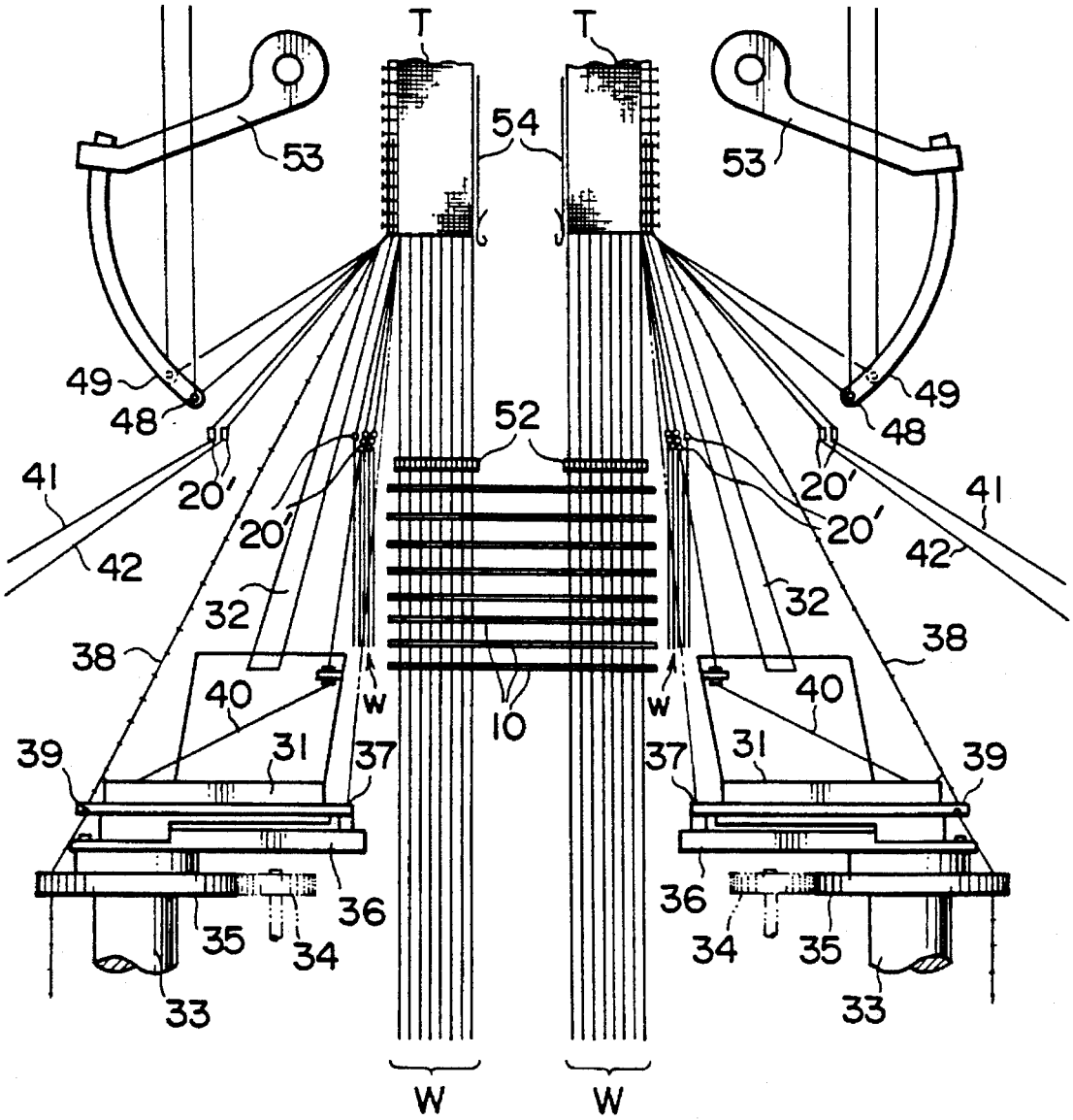
FIG. 4 is a schematic plan view showing a loom in which the shedding device is used.

FIG. 4 is a schematic plan view of a loom in which the above-mentioned shedding device is used. A coupling element forming mandrel 32 extends from a loom frame 31 alongside of the warp yarn row W of a fastener tape T, and a rotary disc 37 is mounted eccentrically on a fixed shaft 33 via gears 34, 35 and a link motion 36. The rotary disc 37 has an axial guide hole 39 through which a coupling element forming synthetic resin filament 38 is to be guided; the guide hole 39 revolves about the mandrel 32 as the rotary disc 37 rotates. The loom frame 31 and the fixed shaft 33 have delivery holes through which a core cord 40 is to be delivered. On the opposite side of the mandrel 32 remote from the warp yarn rows W, healds 20' for shedding anchoring warp yarns 41, 42 to weave and hold the coupling elements is situated. Sideways of the mandrel 32, filling carriers 48, 49 for inserting the weft yarn into the shed of the warp yarns. In FIG. 4, reference character w designates foundation warp yarns of a woven structure for fixing the coupling elements, and 20' designates the heald to be used in shedding the foundation warp yarns w. 10 designates the heald frame to be used for the warp yarn rows of the fastener tape T; 52, a reed; 53, an operating arm of the filling carriers 48, 49; and 54, a latch needle for catching lower weft yarns 47.

Figure 5:
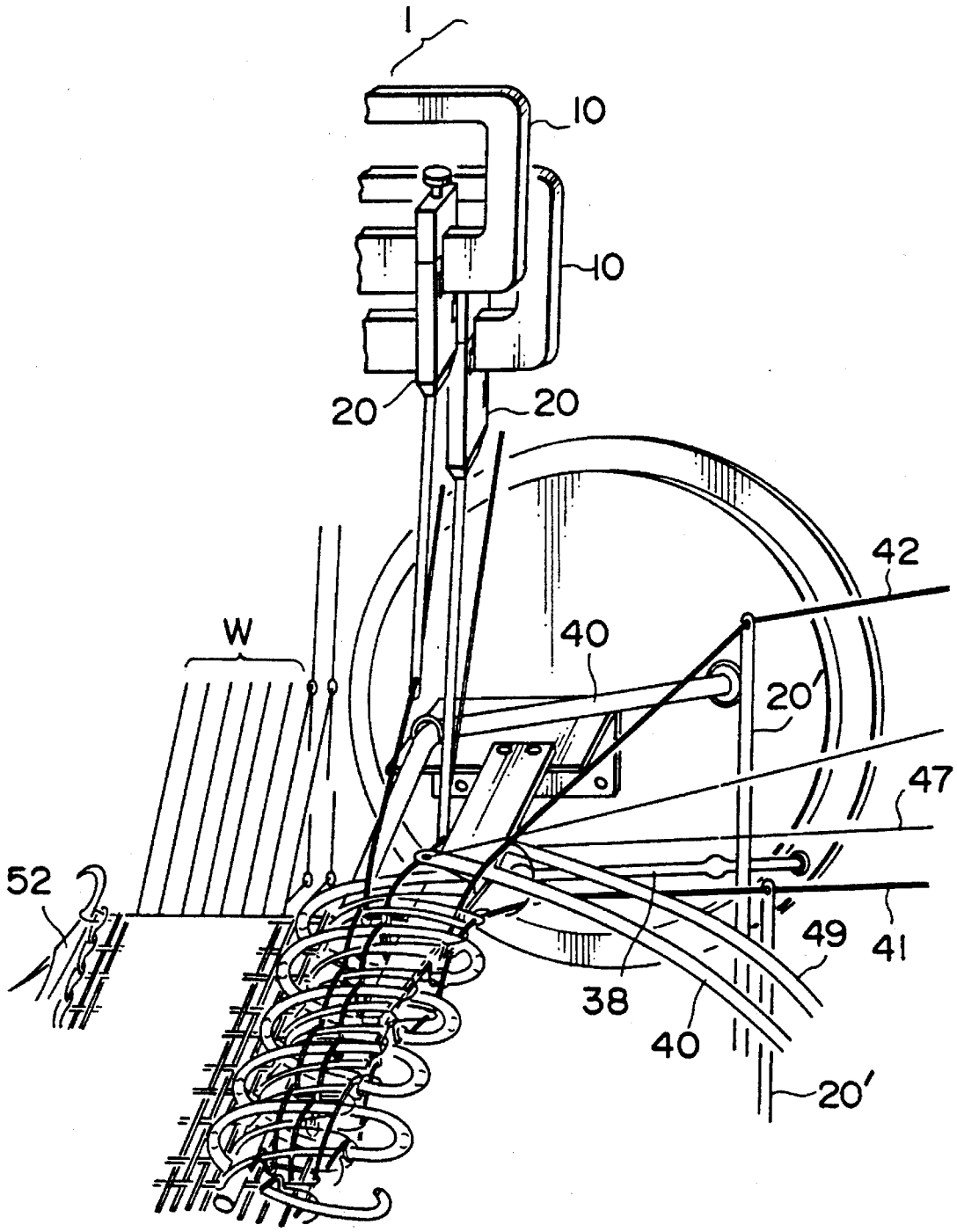
FIG. 5 is a detailed view showing the manner in which a continuous row of coupling elements in the form of a coiled filament is woven into a fastener stringer on the loom simultaneously with the weaving of the fastener stringer.

FIG. 5 shows the manner in which a row of coupling elements in the form of a coiled continuous filament is woven into a fastener stringer simultaneously with the weaving of the fastener stringer. This weaving procedure is disclosed in detail in Japanese Patent Publication No. SHO 59-51814 (U.S. Pat. No. 4,467,840 so its description is omitted here. The coupling element row of a coiled continuous synthetic resin filament 38 is anchored on a coupling element attaching edge of the fastener tape T by the coupling-element-anchoring woven structure including holding yarns extending over the upper leg portions of the coupling elements. The coupling-element-anchoring woven structure includes upper and lower warp yarns and upper and lower weft yarns, at least two anchoring warp yarns extending along the outer edge of the woven structure toward the head portions of the coupling elements. Thus at least two ancoring warp yarns of the coupling-element-anchoring woven structure surround the upper and lower leg portions in symmetry and the upper and lower leg portions of the coupling elements, together with different weft yarns, are interlaced with different warp yarns respectively, to position the coupling heads perpendicularly to the plane of the fastener tape, causing stable coupling of a slide fastener.

As is apparent from the foregoing description, according to the heald frame, since the whole frame structure is made from a composite material composed of a synthetic resin as a base material, and CF, GF or metal fibers as a reinforcing filler, it has a total weight of about 1.2 kg and hence it is possible to reduce the weight by 40 and odds % as compared with the conventional steel frame structure, securing an adequate degree of toughness. Further, since the heald supporting portions, on which the largest inertia is exerted, has a unique shape so as to secure an increased degree of structural toughness, the heald frame is durable and hence suitable for high-speed operation of a loom. For example, the attaching portion of the heald frame is free from being damaged due to inertia and no unnecessary play might be created between the moving part of the heald frame. According to the heald of this invention, it is possible to exchange it with a new one in a simple manner with the heald frame remaining mounted on the loom, thus guaranteeing an effective operation.

What is claimed is:

1. A heald frame, comprising:

(a) a heald support frame for supporting a plurality of healds in parallel, said heald support frame having a central plate portion and a pair of rectangular ring-shaped heald supporting portions extending in opposite directions from said central plate portion; and (b) a heald support extending perpendicularly from said central plate portion, said heald support being integrally connected to said central plate portion of said heald support frame via a generally V-shape joint;

(c) the heald frame composed of a reinforced composite material composed of a synthetic resin and a reinforcing filler; and (d) each of said heald supporting portions including a lower supporting rod for supporting at least one heald.

2. A heald adapted to be supported by a heald supporting rod, said heald comprising:

(a) a bridge having a groove for receiving said heald supporting rod;

(b) a heald body having a base adapted to be connected with said bridge for gripping said heald supporting rod with said bridge; and (c) means for fastening said heald supporting rod between said bridge and said base of said heald body in such a manner that said heald supporting rod is surrounded by said groove of said bridge and a part of said base of the heald body;

(d) said bridge and said base of said heald body having male and female joint portions which are complementary in shape to each other and are slidably and detachably fitted in each other.

3. A heald frame and heald assembly; said heald frame comprises a ring shaped heald supporting portion including a heald supporting rod; and said heald comprises:

a bridge having a groove for receiving said heald supporting rod;

a heald body having a base adapted to be connected with said bridge for gripping said heald supporting rod with said bridge; and means for fastening said heald supporting rod between said bridge and said base of said heald body in such a manner that said heald supporting rod is surrounded by said groove of said bridge and a part of said base of the heald body;

said bridge and said base of said heald body having male and female joint portions which are complementary in shape to each other and are slidably and detachably fitted in each other.

4. The assembly according to claim 3, wherein said heald frame comprises a central plate portion formed integrally with a heald support extending perpendicularly therefrom, said ring shaped supporting portions formed integrally with said central plate portion on opposite sides thereof.

5. The assembly according to claim 4, wherein said heald frame is composed of synthetic resin and a reinforcing filler.

6. A heald frame, comprising:

a heald support frame for supporting a plurality of healds in parallel, said heald support frame having a central portion and a pair of heald supporting portions extending in opposite directions from said central portion;

a heald support extending perpendicularly from said central portion, the heald frame and heald support composed of a reinforced composite material composed of a synthetic resin and a reinforcing filler; and wherein said heald supporting portions are rectangular ring shaped.

7. A heald frame, comprising:

a heald support frame for supporting a plurality of healds in parallel, said heald support frame having a central portion and a pair of heald supporting portions extending in opposite directions from said central portion;

a heald support extending perpendicularly from said Central portion, the heald frame and heald support composed of a reinforced composite material composed of a synthetic resin and a reinforcing filler; and wherein said heald support is integrally connected to said central portion of said heald support frame by a generally V-shaped joint.

* * * * *